US010691050B2

(12) United States Patent
Yagi et al.

(10) Patent No.: US 10,691,050 B2
(45) Date of Patent: Jun. 23, 2020

(54) PRESSURE-APPLYING DEVICE, FIXING DEVICE, AND IMAGE FORMING APPARATUS

(71) Applicant: FUJI XEROX CO., LTD., Tokyo (JP)

(72) Inventors: Motoyuki Yagi, Kanagawa (JP); Kazuaki Iikura, Kanagawa (JP); Noriaki Kishi, Kanagawa (JP); Masahiro Akatsuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/391,269

(22) Filed: Apr. 22, 2019

(65) Prior Publication Data

US 2020/0166878 A1 May 28, 2020

(30) Foreign Application Priority Data

Nov. 28, 2018 (JP) ..... 2018-221826

(51) Int. Cl.
*G03G 15/20* (2006.01)

(52) U.S. Cl.
CPC ..... *G03G 15/2064* (2013.01); *G03G 15/206* (2013.01); *G03G 15/2017* (2013.01); *G03G 2215/2003* (2013.01); *G03G 2215/2009* (2013.01); *G03G 2215/2025* (2013.01); *G03G 2215/2035* (2013.01); *G03G 2215/2041* (2013.01)

(58) Field of Classification Search
CPC ..... G03G 15/206; G03G 15/2017; G03G 15/2064; G03G 2215/2003; G03G 2215/2009; G03G 2215/2025; G03G 2215/2035; G03G 2215/2041
See application file for complete search history.

(56) References Cited

U.S. PATENT DOCUMENTS

| | | | | |
|---|---|---|---|---|
| 9,020,409 | B2 * | 4/2015 | Kuroda | G03G 15/2053 399/329 |
| 9,158,250 | B2 * | 10/2015 | Imada | G03G 15/2064 |
| 2006/0083567 | A1 * | 4/2006 | Ito | G03G 15/206 399/400 |
| 2006/0216077 | A1 * | 9/2006 | Komuro | G03G 15/206 399/328 |
| 2008/0292374 | A1 * | 11/2008 | Hiraoka | G03G 15/206 399/328 |
| 2009/0208263 | A1 * | 8/2009 | Hanyu | G03G 15/2064 399/329 |
| 2011/0200372 | A1 * | 8/2011 | Arakawa | G03G 15/206 399/333 |

FOREIGN PATENT DOCUMENTS

| | | |
|---|---|---|
| JP | 2001318544 | 11/2001 |
| JP | 2002082554 | 3/2002 |

* cited by examiner

*Primary Examiner* — Ryan D Walsh
(74) *Attorney, Agent, or Firm* — JCIPRNET

(57) ABSTRACT

A pressure-applying device includes a pressure-applying portion that applies pressure to a pressure-receiving object and a pressing portion that presses the pressure-applying portion toward the pressure-receiving object, the pressing portion having a hardness higher than a hardness of the pressure-applying portion. The pressure-applying portion includes plural projections that project from a back surface of the pressure-applying portion that faces the pressing portion toward a pressing surface of the pressing portion that faces the pressure-applying portion.

10 Claims, 13 Drawing Sheets

PRESSURE-APPLYING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2018-221826 filed Nov. 28, 2018.

BACKGROUND

(i) Technical Field

The present disclosure relates to a pressure-applying device, a fixing device, and an image forming apparatus.

(ii) Related Art

There are apparatuses that are required to apply uniform pressure to a pressure-receiving object so that the pressure is evenly distributed. A fixing device will be described as an example of such an apparatus. The fixing device described herein includes a pair of fixing portions to which a paper sheet having a toner image formed thereon is transported and that fixes the toner image to the paper sheet by applying heat and pressure to the paper sheet while nipping the paper sheet.

Japanese Unexamined Patent Application Publication No. 2001-318544 discloses a fixing device including ribs for positioning a pressure-applying member.

Japanese Unexamined Patent Application Publication No. 2002-082554 discloses a fixing device including springs that are arranged at plural locations in a sheet width direction and via which pressure is applied.

SUMMARY

A fixing device is required to apply pressure to a paper sheet nipped between a pair of fixing portions such that the pressure is sufficiently uniform in a sheet width direction to achieve the required fixing performance. Therefore, a pressure-applying member of the fixing device is required to satisfy very severe precision requirements, which leads to high costs and low mass productivity.

The above-described problem is not limited to fixing devices, but is common among pressure-applying devices required to apply uniform pressure to a pressure-receiving object.

Aspects of non-limiting embodiments of the present disclosure relate to a pressure-applying device, a fixing device, and an image forming apparatus in which pressure variation may be reduced even when the precision of a pressure-applying member is low.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a pressure-applying device including a pressure-applying portion that applies pressure to a pressure-receiving object and a pressing portion that presses the pressure-applying portion toward the pressure-receiving object, the pressing portion having a hardness higher than a hardness of the pressure-applying portion. The pressure-applying portion includes plural projections that project from a back surface of the pressure-applying portion that faces the pressing portion toward a pressing surface of the pressing portion that faces the pressure-applying portion.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described.

Figure 1:
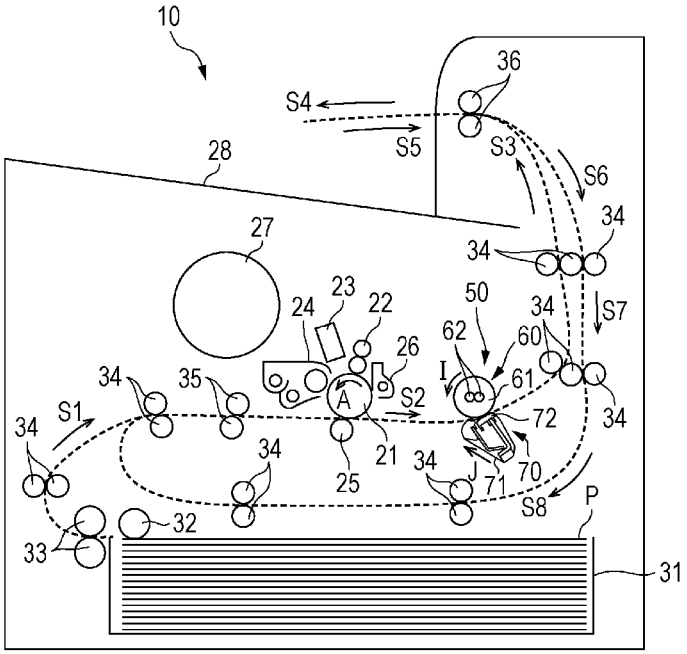
FIG. 1 is a schematic diagram illustrating an image forming apparatus according to an exemplary embodiment of the present disclosure.

FIG. 1 is a schematic diagram illustrating an image forming apparatus 10 according to an exemplary embodiment of the present disclosure.

The image forming apparatus 10 illustrated in FIG. 1 includes a pressure-applying device according to an exemplary embodiment of the present disclosure and a fixing device according to a first exemplary embodiment of the present disclosure.

The image forming apparatus 10 receives an image signal from an external device (not shown), such as a personal computer, that serves as a source of image information. The image forming apparatus 10 forms an image based on the received image signal.

A paper sheet tray 31 is disposed in a lower section of the image forming apparatus 10. Paper sheets P are stacked on the paper sheet tray 31. The paper sheet tray 31 is capable of being pulled out when the paper sheets P are to be supplied thereto.

The paper sheets P are fed from the paper sheet tray 31 by a pickup roller 32. The paper sheets P that have been fed are separated from each other by separation rollers 33, and one paper sheet P that has been separated from the other paper sheets P is transported in the direction of arrow S1 by transport rollers 34 until the leading end of the paper sheet P reaches standby rollers 35. The standby rollers 35 have a function of feeding the paper sheet P while adjusting the timing at which the paper sheet P is further transported. The paper sheet P that has reached the standby rollers 35 is further transported at the timing adjusted by the standby rollers 35.

The image forming apparatus 10 includes a photoconductor 21 that rotates in the direction indicated by arrow A. A charging device 22, an exposure device 23, a developing unit 24, a transfer device 25, and a cleaner 26 are arranged around the photoconductor 21.

The photoconductor 21, which has a cylindrical shape, holds electric charges when charged and releases the electric charges when exposed to light. Thus, an electrostatic latent image is formed on the surface of the photoconductor 21.

The charging device 22 charges the surface of the photoconductor 21 to a certain charge potential.

The exposure device 23 irradiates the photoconductor 21 with exposure light modulated in accordance with the image signal received from the external device, thereby forming an electrostatic latent image on the surface of the photoconductor 21.

The developing unit 24 forms a toner image on the surface of the photoconductor 21 by developing the electrostatic latent image formed on the surface of the photoconductor 21 with toner.

A toner bottle 27 containing the toner is disposed obliquely above the developing unit 24. The toner contained in the developing unit 24 is consumed when used in the developing process. When the toner contained in the developing unit 24 is consumed, the toner contained in the toner bottle 27 is supplied to the developing unit 24.

The above-described standby rollers 35 feed the paper sheet P so that the paper sheet P reaches a transfer position, which faces the transfer device 25, at the time when the toner image on the photoconductor 21 reaches the transfer position. The transfer device 25 transfers the toner image on the photoconductor 21 onto the paper sheet P that has been fed. The toner that remains on the photoconductor 21 after the toner image has been transferred is removed from the photoconductor 21 by the cleaner 26.

The paper sheet P to which the toner image has been transferred is transported in the direction of arrow S2 and is heated and pressed by the fixing unit 50 so that an image composed of a fixed toner image is formed on the paper sheet P.

The fixing unit 50 includes a heating device 60 and a pressure-applying device 70.

The heating device 60 includes a heating roller 61 having a hollow cylindrical shape and halogen lamps 62 that are disposed in the heating roller 61 and that serve as a heat source.

The pressure-applying device 70 includes an endless pressure-applying belt 71 and a backing member 72 disposed inside the pressure-applying belt 71. The pressure-applying belt 71 is pressed against the heating roller 61 by the backing member 72. The heating roller 61 and the pressure-applying belt 71 rotate in the directions of arrows I and J while being pressed against each other. The paper sheet P that has been transported in the direction of arrow S2 and reached the fixing unit 50 receives heat and pressure by being nipped between the heating roller 61 and the pressure-applying belt 71, so that the toner image is fixed to the paper sheet P. The heating device 60 and the pressure-applying device 70 are an example of a pair of fixing portions according to the present disclosure. The pressure-applying device 70 will be described in detail below.

The paper sheet P that has passed the fixing unit 50 is transported by the transport rollers 34 in the direction of arrow S3, and is further transported by the discharge rollers 36 in the direction of arrow S4 and discharged onto a tray 28.

The image forming apparatus 10 is capable of forming images on both sides of the paper sheet P. When images are to be formed on both sides of the paper sheet P, first, an image is formed on a first side of the paper sheet P by the same process as the above-described process. Then, the paper sheet P having an image formed only on the first side thereof is transported by the discharge rollers 36 in the direction of arrow S4 to a reversing position at which the trailing end of the paper sheet P is nipped between the discharge rollers 36. When the paper sheet P reaches the reversing position, the rotating directions of the discharge rollers 36 are reversed. Accordingly, the paper sheet P is pulled in the direction of arrow S5, which is opposite to the direction of arrow S4. The pulled paper sheet P moves in the direction of arrow S6, and is further transported by the transport rollers 34 in the directions of arrows S7 and S8 so that the paper sheet P reaches the standby rollers 35 again. The paper sheet P reaches the standby rollers 35 again in a position reversed from that of the paper sheet P when an image is formed on the first side thereof.

The standby rollers 35 feed the paper sheet P in such a position that a second side of the paper sheet P, which is opposite to the first side on which an image is formed, faces the photoconductor 21. After that, an image is formed on the second side similarly to the manner in which an image is formed on the first side. Then, the paper sheet P having images formed on both sides thereof is discharged onto the tray 28.

Figure 2:
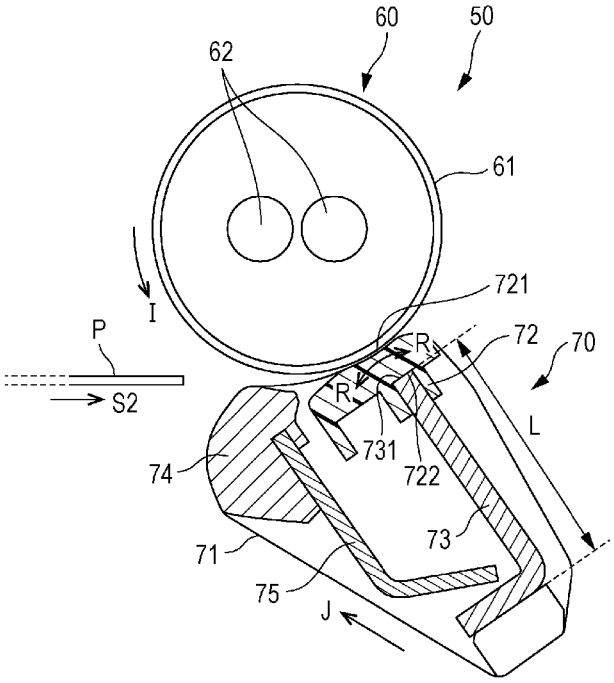
FIG. 2 is a schematic enlarged view of a fixing unit.

FIG. 2 is a schematic enlarged view of the fixing unit 50. The fixing unit 50 illustrated in FIG. 2 corresponds to the fixing device according to the first exemplary embodiment of the present disclosure.

As described above, the fixing unit 50 includes the endless pressure-applying belt 71 and the backing member 72 disposed inside the pressure-applying belt 71. The backing member 72 is supported by a support member 73. The pressure-applying belt 71 surrounds the backing member 72 and the support member 73, and circulates in the direction of arrow J while being in contact with a front surface 721 of the backing member 72.

The support member 73 has a pressing surface 731 that faces the backing member 72. The pressing surface 731 of the support member 73 presses a back surface 722 of the backing member 72 that faces the support member 73. The backing member 72 is pressed by the support member 73, and thereby applies pressure to the heating roller 61 with the pressure-applying belt 71 disposed therebetween.

The paper sheet P that has been transported in the direction of arrow S2 is nipped between the heating roller 61 and the pressure-applying belt 71. When the paper sheet P is nipped, the backing member 72 applies pressure to the nipped paper sheet P with the pressure-applying belt 71 disposed therebetween. Thus, according to the first exemplary embodiment, the pressure-applying belt 71 is provided so that the paper sheet P is capable of receiving pressure while being transported by the rotation of the pressure-applying belt 71.

The pressure-applying belt 71, the backing member 72, and the support member 73 according to the first exemplary embodiment are examples of a belt, a pressure-applying portion, and a pressing portion, respectively, according to the present disclosure.

The support member 73 has a hardness higher than that of the backing member 72. In this specification, the magnitude of "hardness" is defined as the magnitude of Vickers hardness. The support member 73 may be made of, for example, SUS304 and may have a Vickers hardness of about 200 HV. The backing member 72 may be made of, for example, a liquid crystal polymer. The backing member 72 may instead be made of a rigid resin (resin that is not rubber elastic) other than liquid crystal polymers. For example, polyphenylene sulfide (PPS), polyimide, polyester, or polyamide may be used. The backing member 72 may have a Vickers hardness of, for example, 20 HV or less.

The pressure-applying device 70 illustrated in FIG. 2 further includes a second backing member 74 and a second support member 75. The second backing member 74 has a function of increasing the length of a region (nip region) in which the paper sheet P is nipped between the heating roller 61 and the pressure-applying belt 71. The second support member 75 supports the second backing member 74. The second backing member 74 and the second support member 75 are not features of the present disclosure, and further description thereof is omitted.

Figure 3:
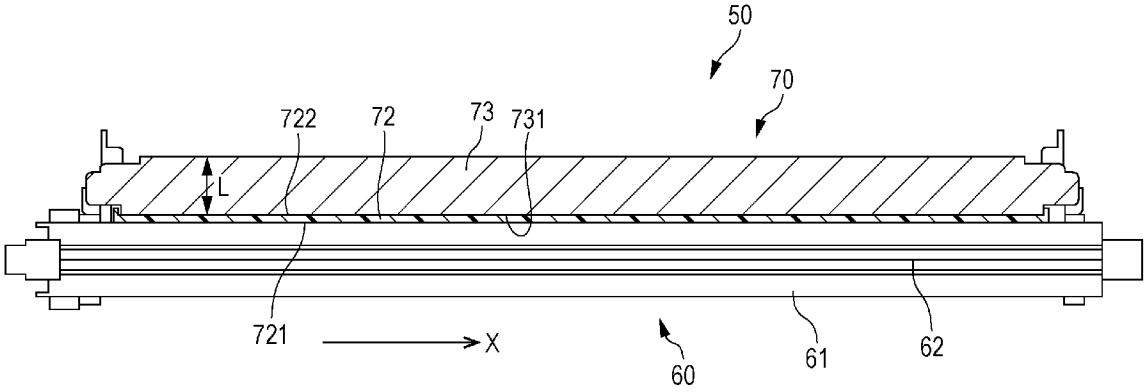
FIG. 3 RELATED ART
FIG. 3 is a sectional view of a fixing unit (comparative example) taken in a longitudinal direction (direction perpendicular to the plane of FIG. 2)

FIG. 3 is a sectional view of a fixing unit (comparative example) taken in a longitudinal direction (direction perpendicular to the plane of FIG. 2). In FIG. 3, the fixing unit is positioned such that the pressure-applying device 70 is above the heating device 60, and the pressure-applying belt 71 (see FIG. 2) is not illustrated. The fixing unit illustrated in FIG. 3 is a fixing unit according to the related art that does not include characterizing portions of the first exemplary embodiment of the present disclosure. More specifically, the fixing unit 50 illustrated in FIG. 3 is a comparative example with which the first exemplary embodiment of the present disclosure is to be compared. However, to facilitate understanding, the fixing unit illustrated in FIG. 3 and components thereof are denoted by the same reference numerals as those of the fixing unit 50 according to the first exemplary embodiment and the components thereof.

One of the performance requirements for the fixing unit 50 is to apply pressure to the paper sheet P nipped between the heating roller 61 and the pressure-applying belt 71 such that the pressure is sufficiently uniform at any position in the longitudinal direction (direction of arrow X) to achieve the required fixing performance. Therefore, the support member 73 that presses the backing member 72 is required to satisfy very severe precision requirements. One of the problems of the fixing unit 50 is that the precision requirements cannot be satisfied.

Figure 4:
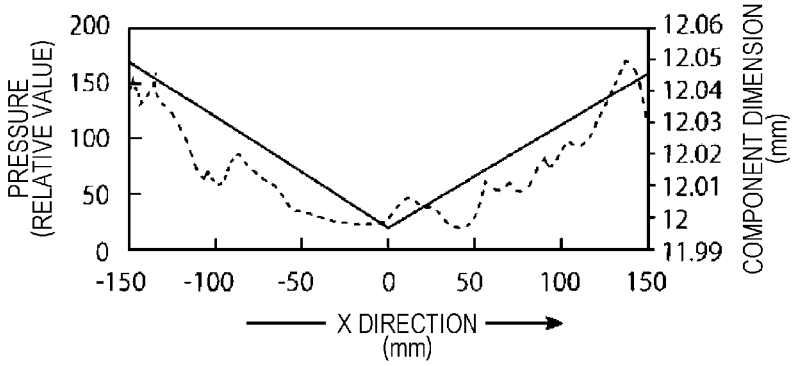
FIG. 4 RELATED ART
FIG. 4 is a graph showing the relationship between the dimensional precision of the support member and the pressure variation.

FIG. 4 is a graph showing the relationship between the dimensional precision of the support member and the pressure variation. The horizontal axis of FIG. 4 represents the position in the longitudinal direction (direction of arrow X) in FIG. 3.

In the graph of FIG. 4, the right vertical axis represents the dimension of the support member 73 (length L in FIGS. 2 and 3) at each position in the longitudinal direction, plotted along the solid line. As is clear from the solid line in the graph of FIG. 4, the dimension of the support member 73 is small in a central region and increases toward the ends in the longitudinal direction.

In addition, in the graph of FIG. 4, the left vertical axis represents the pressure (relative value) applied to the pressure-applying belt 71 by the backing member 72 at each position in the longitudinal direction, plotted along the broken line. The graph shows that since the dimension of the support member 73 increases toward the ends, the pressing force received by the backing member 72 increases toward the ends accordingly. The pressure distribution or variation is determined by placing a pressure sensor in the nip region at a predetermined temperature (for example, in the range of 5 to 50 degrees) and measuring the pressure with a certain pressure distribution measurement device (for example, a tactile sensor system produced by NITTA Corporation).

The backing member 72 is expected to receive a uniform pressing force from the support member 73 at any position in the longitudinal direction. However, in practice, the pressing force varies due to variation in the dimension of the support member 73 in the longitudinal direction.

Figure 5:
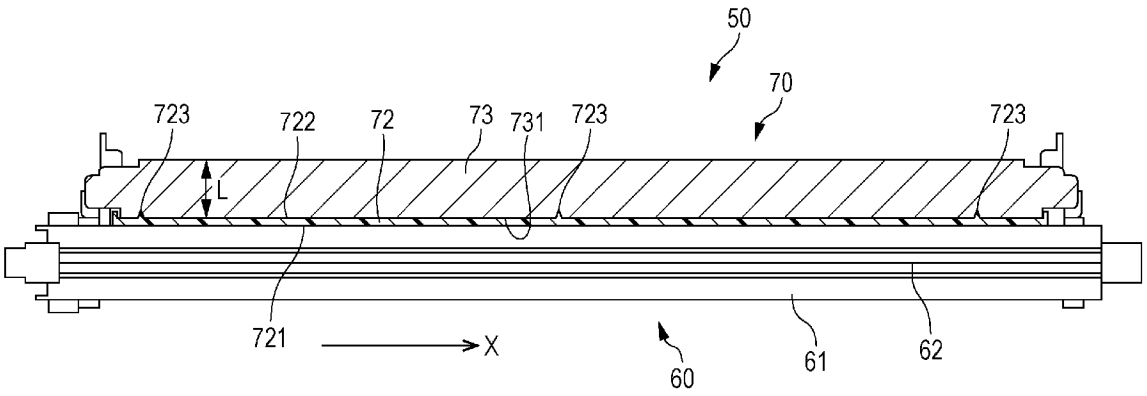
FIG. 5 is a sectional view of a fixing unit (first exemplary embodiment) taken in a longitudinal direction (direction perpendicular to the plane of FIG. 2)

FIG. 5 is a sectional view of a fixing unit (first exemplary embodiment) taken in a longitudinal direction (direction perpendicular to the plane of FIG. 2). Similar to FIG. 3, also in FIG. 5, the fixing unit is positioned such that the pressure-applying device 70 is above the heating device 60, and the pressure-applying belt 71 (see FIG. 2) is not illustrated.

Only the difference from the fixing unit (comparative example) illustrated in FIG. 3 will be described.

The fixing unit 50 according to the first exemplary embodiment illustrated in FIG. 5 is configured such that plural projections 723 (three projections 723 in FIG. 5) project from the back surface 722 of the backing member 72 that faces the support member 73 toward the pressing surface 731 of the support member 73 that faces the backing member 72. Among the three projections 723, the projection 723 at the center is disposed in a region where the paper sheet having the smallest width among the paper sheets used in the image forming apparatus 10 (see FIG. 1) passes, for example, at the center in the longitudinal direction (direction of arrow X). In addition, the two projections 623 other than the projection 623 at the center that are at both ends are disposed within plus/minus 20 mm from the edges in the width direction of the paper sheet having the largest width among the paper sheets used in the image forming apparatus 10 (see FIG. 1). At least an end portion of at least one of the projections 723 is deformed by being pressed by the support member 73 when the backing member 72 and the support member 73 are assembled together.

Figure 6A:
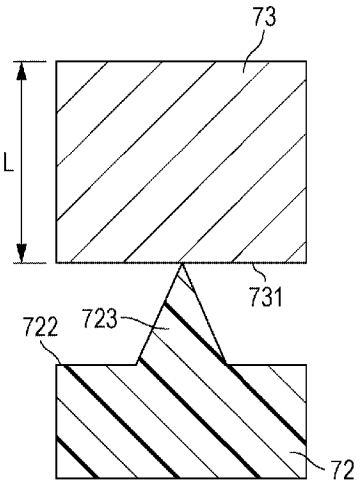
FIGS. 6A, 6B, and 6C are schematic diagrams illustrating the manner in which a projection formed on a backing member is deformed.
Figure 6B:
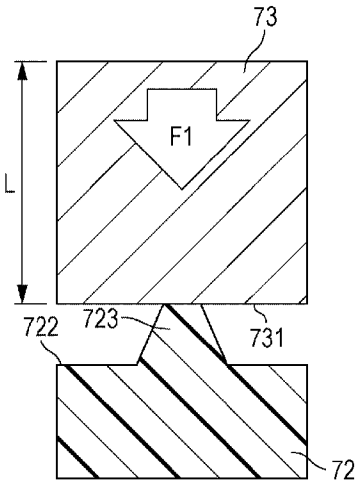

FIGS. 6A, 6B, and 6B are schematic diagrams illustrating the manner in which one of the projections 723 formed on the backing member 72 is deformed.

FIG. 6A illustrates the manner in which the pressing surface 731 of the support member 73 is in contact with a tip portion of the projection 723 of the backing member 72 when the backing member 72 and the support member 73 are assembled together. As illustrated in FIG. 6A, according to the first exemplary embodiment, the projection 723 is tapered toward the support member 73. When the dimension L of the support member 73 is small, there is a possibility that the projection 723 is not deformed, as illustrated in FIG. 6A.

FIG. 6B illustrates the case in which the dimension L of the support member 73 is somewhat greater than that in FIG. 6A. Since the hardness of the backing member 72 is less than that of the support member 73, the projection 723 is deformed by a pressing force F1 applied by the support member 73. In the first exemplary embodiment, since the projection 723 is tapered, the projection 723 is deformed more stably than a projection whose dimension is constant to the end thereof.

Figure 6C:
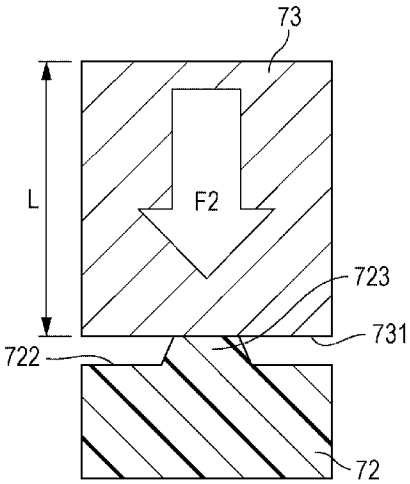

FIG. 6C illustrates the case in which the dimension L of the support member 73 is greater than that in FIG. 6B. In this case, the projection 723 receives a strong pressing force F2 (F1<F2) from the support member 73 and is greatly deformed.

When no projection 723 is formed as illustrated in FIG. 3, the entire area of back surface 722 of the backing member 72 is pressed by the entire area of the pressing surface 731 of the support member 73. In contrast, when the projections 723 are formed as illustrated in FIGS. 6A, 6B, and 6C, the pressing force applied by the pressing surface 731 of the support member 73 is received by the projections 723 formed on the back surface 722 of the backing member 72.

Figure 7:
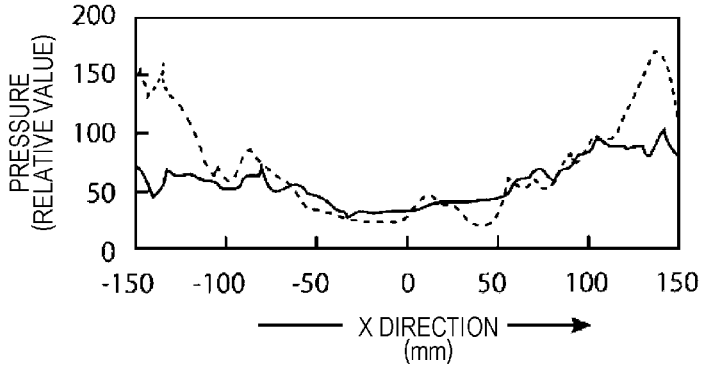
FIG. 7 is a graph showing the variation in the pressure applied to a pressure-applying belt by the backing member.

FIG. 7 is a graph showing the variation in the pressure applied to pressure-applying belt 71 by the backing member 72. Similar to FIG. 4, the horizontal axis of FIG. 7 represents the position in the longitudinal direction (direction of arrow X).

In the graph of FIG. 7, the broken line is the same as the broken line in the graph of FIG. 4, which represents the pressure variation in the case where the fixing unit 50 has no projections 723 as illustrated in FIG. 3. Although FIG. 7 does not show the dimensional variation of the support member 73, the support member 73 having the dimensional variation represented by the solid line in FIG. 4 is used.

In the graph of FIG. 7, the solid line represents the pressure variation in the case where the same support member 73 is used and the fixing unit 50 includes the projections 723 as illustrated in FIG. 5.

As is clear from FIG. 7, when the projections 723 are provided, the projections 723 are deformed in accordance with the dimensional variation of the support member 73, so that the pressing force is made more uniform and variation in the pressing force is reduced even when the support member 73 having the same dimensional variation is used. As a result, variation in the pressure applied by the backing member 72 is reduced, so that the paper sheet nipped between the heating roller 61 and the pressure-applying belt 71 receives pressure with less variation. In the case where the pressure variation that occurs when no projections 723 are formed is tolerable, the dimensional precision of the support member 73 may be reduced. Accordingly, the costs may be reduced and the mass productivity may be increased.

In the first exemplary embodiment illustrated in FIG. 5, three projections 723 are formed to project toward the pressing surface 731 of the support member 73 that faces the backing member 72. Accordingly, the pressure variation is less than when the projections 723 are provided only at two locations. However, the number of projections 723 is not limited to two or three, and may be four or more.

Modifications of the first exemplary embodiment will now be described.

Figure 8:
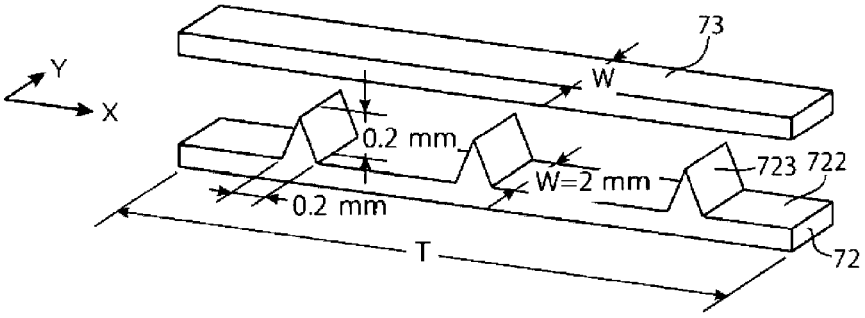
FIG. 8 is a schematic diagram illustrating a first modification.

FIG. 8 is a schematic diagram illustrating a first modification.

FIG. 8 schematically illustrates the backing member 72 and the support member 73. In FIG. 8, the width of the back surface 722 of the backing member 72 in the direction of arrow Y that crosses the longitudinal direction (direction of arrow X) and the width of a portion of the support member 73 that presses the backing member 72 in the direction of arrow Y are both W. The direction of arrow Y is the direction in which the paper sheet is transported (direction of arrow S2 in FIGS. 1 and 2), and is typically orthogonal to the direction of arrow X. In the first modification, the projections 723 have, for example, a width in the direction of arrow X of about 0.2 mm, a height of about 0.2 mm, and a width in the direction of arrow Y of about 2 mm.

In the first modification, the projections 723 extend over the entire width W in the direction of arrow Y. In the first modification, the direction of arrow Y is an example of a first direction that is parallel to the back surface 722 according to the present disclosure. In addition, according to the first modification, a length T of the backing member 72 and the support member 73 in the direction of arrow X is longer than or equal to the width of the paper sheet P having the maximum width among the paper sheets P used in the image forming apparatus 10 (see FIG. 1).

Figure 9:
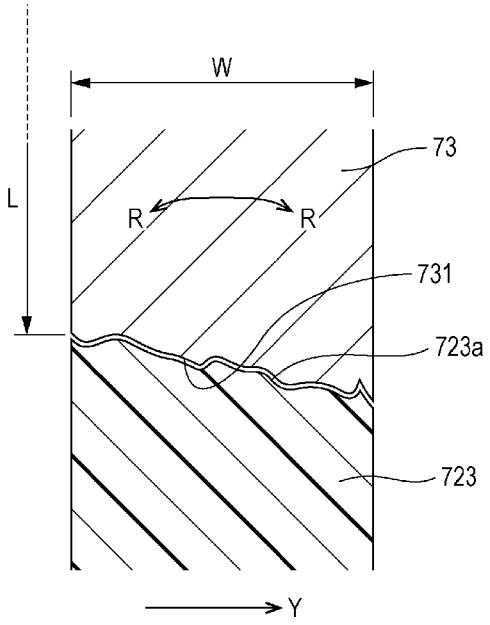
FIG. 9 illustrates the effect of a projection that extends over the entire width W in the direction of arrow Y.

FIG. 9 illustrates the effect of a projection that extends over the entire width W in the direction of arrow Y.

The pressing surface 731 of the support member 73 is, for example, a cut surface of a metal member. Therefore, the length L to the pressing surface 731 also varies in the direction of arrow Y. When the projection 723 is pressed by the pressing surface 731 of the support member 73, the projection 723 is deformed in accordance with the variation of the dimension L of the support member 73 in the direction of arrow Y so as to form a deformed surface 723*a* that follows the shape of the pressing surface 731. In the first modification illustrated in FIGS. 8 and 9, the projection 723 extends over the entire width W of the support member 73, so that the pressure variation is reduced over the entire length of the pressing surface 731 in the direction of arrow Y. In addition, displacement of the backing member 72 in the direction of arrow R-R (see also the direction of arrow R-R in FIG. 2) is reduced. Also when the length of the projection 723 in the direction of arrow Y is longer than the entire width W of the support member 73, the pressure variation is reduced over the entire length of the pressing surface 731 in the direction of arrow Y, and displacement in the direction of arrow R-R is minimized.

Figure 10:
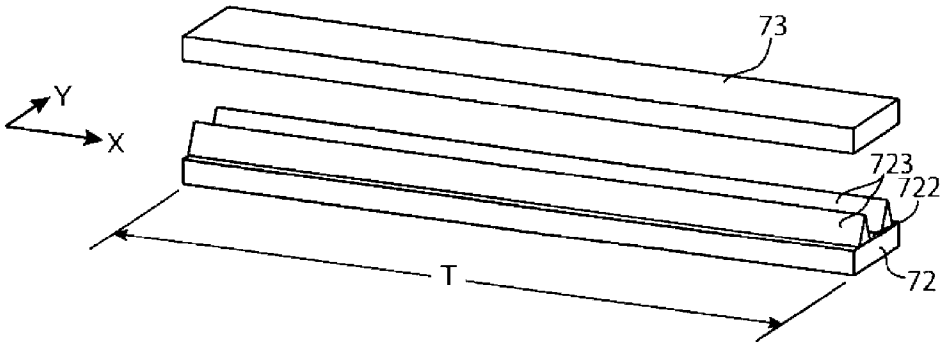
FIG. 10 is a schematic diagram illustrating a second modification.

FIG. 10 is a schematic diagram illustrating a second modification. Also in FIG. 10, the direction of arrow Y is the direction in which the paper sheet is transported (direction of arrow S2 in FIGS. 1 and 2) that crosses the arrow X, and is typically orthogonal to the direction of arrow X.

In the second modification, the projections 723 extend over the entire length T in the direction of arrow X. The length T is longer than or equal to the width of the paper sheet nipped between the heating roller 61 and the pressure-applying belt 71. In the second modification, the direction of arrow X is an example of a first direction that is parallel to the back surface 722 according to the present disclosure.

In the second modification, the pressing surface 731 (see FIG. 5) of the support member 73 does not press the projections 723 at discrete positions in the direction of arrow X but presses the projections 723 over the entire length T. Therefore, the projections 723 are deformed so as to follow the variation in the length L of the support member 73 over the entire length in the direction of arrow X. Accordingly, the pressure variation in the direction of arrow X may be further reduced.

Figure 11:
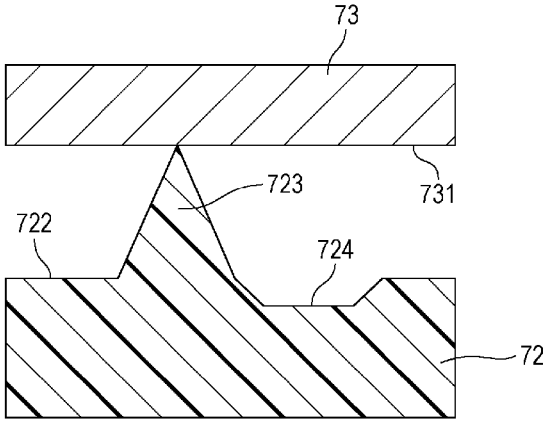
FIG. 11 is a schematic diagram illustrating a third modification.

FIG. 11 is a schematic diagram illustrating a third modification. FIG. 11 is an enlarged sectional view of a portion including one of the projections 723 formed on the backing member 72.

In the third modification, a recess 724 is formed in the back surface 722 of the backing member 72 at a location adjacent to each projection 723. When the recess 724 is formed, a space sufficient to receive the material of the projection 723 is provided when the projection 723 is pressed and deformed by the support member 73.

Figure 12:
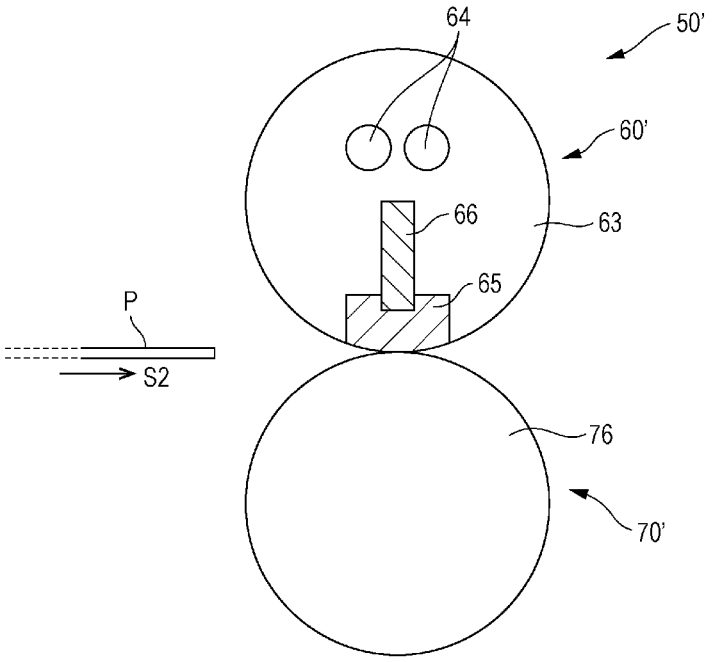
FIG. 12 is a schematic diagram illustrating a fixing unit according to a second exemplary embodiment of the present disclosure.

FIG. 12 is a schematic diagram illustrating a fixing unit 50' according to a second exemplary embodiment of the present disclosure.

The fixing unit 50' according to the second exemplary embodiment illustrated in FIG. 12 includes a heating device 60' and a pressure-applying device 70'. The heating device 60' and the pressure-applying device 70' are an example of a pair of fixing portions according to the present disclosure.

The heating device 60' includes an endless heating belt 63. The pressure-applying device 70' includes a pressure-applying roller 76. The heating device 60' also includes halogen lamps 64, a backing member 65, and a support member 66, all of which are disposed inside the heating belt 63. The backing member 65 is pressed by the support member 66, and thereby presses the pressure-applying roller 76 with the heating belt 63 interposed therebetween.

A paper sheet P that has been transported in the direction of arrow S2 is nipped between the heating belt 63 and the pressure-applying roller 76, and thereby receives heat and pressure, so that a toner image is fixed to the paper sheet P.

The backing member 65 and the support member 66 are examples of a pressure-applying portion and a pressing portion, respectively, according to the present disclosure.

Figure 13:
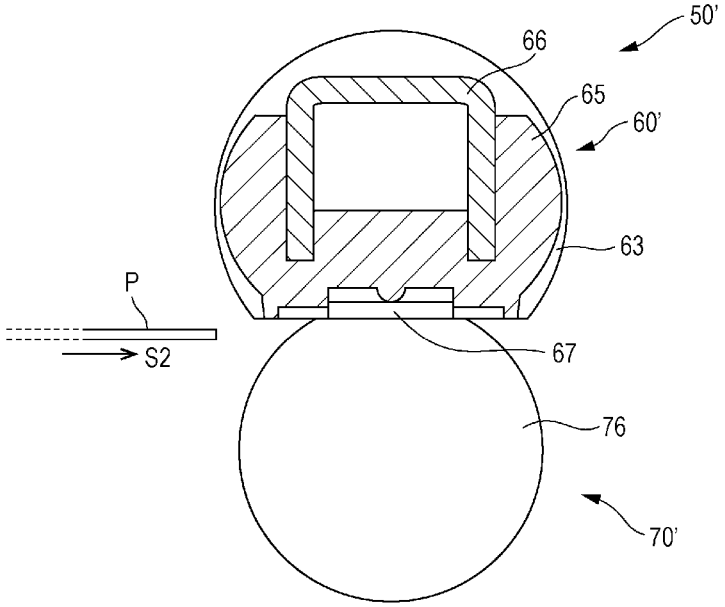
FIG. 13 is a schematic diagram illustrating a fixing unit according to a third exemplary embodiment of the present disclosure.

FIG. 13 is a schematic diagram illustrating a fixing unit 50' according to a third exemplary embodiment of the present disclosure. In FIG. 13, components corresponding to the components of the fixing unit 50' illustrated in FIG. 12 are denoted by the same references as those in FIG. 12 even when the components have different shapes, and only the differences in characteristics will be described.

The fixing unit 50' according to the third exemplary embodiment illustrated in FIG. 13 includes a heating device 60' and a pressure-applying device 70'. Similar to the second exemplary embodiment illustrated in FIG. 12, the heating device 60' includes an endless heating belt 63, and also includes a backing member 65 and a support member 66 disposed inside the heating belt 63. The pressure-applying device 70' includes a pressure-applying roller 76. The heating device 60' also includes a planar heater 67 disposed to face the pressure-applying roller 76 with the heating belt 63 provided therebetween. The planar heater 67 serves as a heat source in place of the halogen lamps 64 illustrated in FIG. 12. A paper sheet P that has been transported in the direction of arrow S2 is nipped between the heating belt 63 and the pressure-applying roller 76, and thereby receives heat and pressure, so that a toner image is fixed to the paper sheet P.

Similar to the second exemplary embodiment illustrated in FIG. 12, the backing member 65 and the support member 66 are examples of a pressure-applying portion and a pressing portion, respectively, according to the present disclosure.

In the above-described first exemplary embodiment, the pressure-applying device 70 includes the backing member 72 and the support member 73. However, as in the second exemplary embodiment illustrated in FIG. 12 and the third exemplary embodiment illustrated in FIG. 13, the heating device 60' may include the backing member 65 and the support member 66, which are examples of a pressure-applying portion and a pressing portion, respectively, according to the present disclosure.

Although the projections 723 having the shape of a horizontally extending triangular prism are described as an example of projections, the shape of the projections according to the present disclosure is not limited, and may instead be, for example, the shape of a cone, such as a circular cone or a pyramid, or a hemispherical shape. In addition, the projections are not necessarily tapered, and may have, for example, a cylindrical shape or a rectangular prism shape.

Although the fixing units 50 and 50' are described herein as examples, the pressure-applying device according to the present disclosure is not limited to a fixing unit, and may be any device required to apply pressure uniformly in the width direction of the paper sheet P that is transported. For example, the pressure-applying device may be the transfer device 25 illustrated in FIG. 1. As a broader example, the pressure-applying device according to the present disclosure may be any device required to apply uniform pressure to a pressure-receiving object over a linear or planar region. In such a case, if the pressure-receiving object to which pressure is to be applied is stationary, the belt-shaped member, such as the pressure-applying belt 71 or the heating belt 63, may be omitted.

Figure 14:
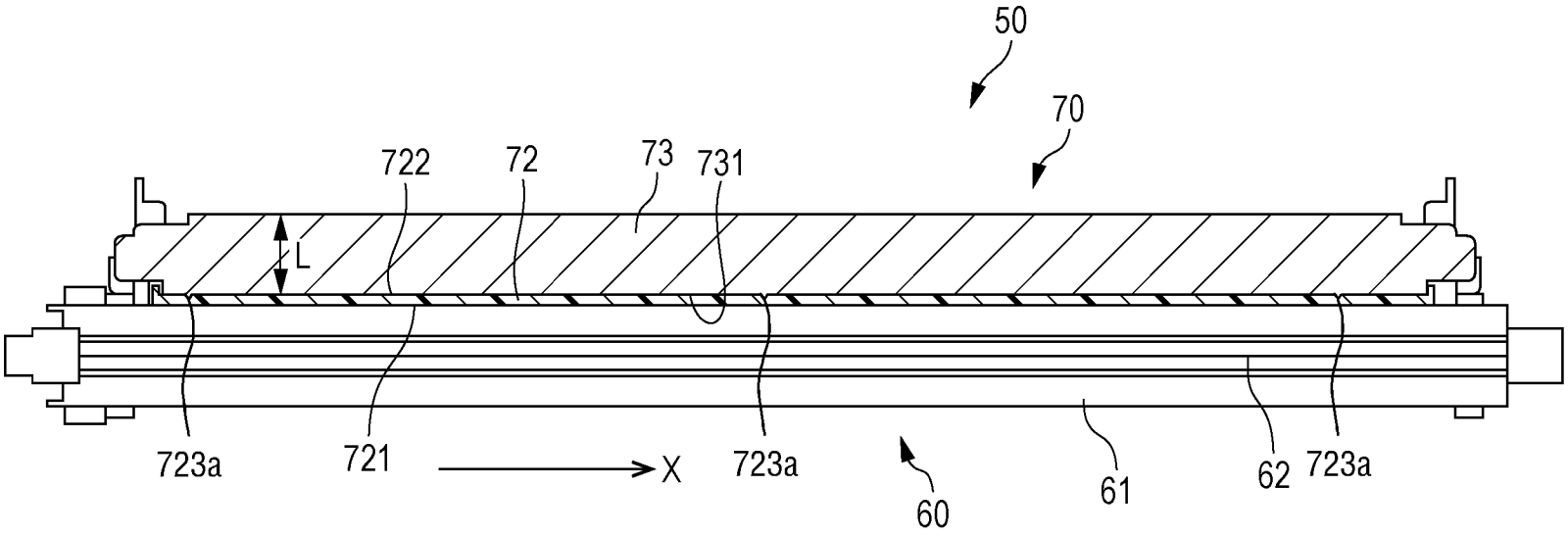
FIG. 14 is a sectional view of a fixing unit taken in a longitudinal direction according to an exemplary embodiment of the present disclosure.

In the above-described example, the support member 73 has a hardness higher than that of the backing member 72, and the projections 723 project from the back surface 722 of the backing member 72 that faces the support member 73 toward the pressing surface 731 of the support member 73 that faces the backing member 72. However, according to an exemplary embodiment of the present disclosure, the support member 73 may have a hardness lower than that of the backing member 72, and projections 723*a* may be formed to project from the pressing surface 731 of the support member 73 that faces the backing member 72 toward the back surface 722 of the backing member 72 that faces the support member 73, as shown in FIG. 14.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A pressure-applying device comprising:

a pressure-applying portion that applies pressure to a pressure-receiving object; and a pressing portion that presses the pressure-applying portion toward the pressure-receiving object, the pressing portion having a hardness higher than a hardness of the pressure-applying portion, wherein the pressure-applying portion includes a plurality of projections that project from a back surface of the pressure-applying portion that faces the pressing portion toward a pressing surface of the pressing portion that faces the pressure-applying portion, wherein at least an end portion of at least one of the projections is deformed by being pressed by the pressing portion when the pressure-applying portion and the pressing portion are assembled together.

2. The pressure-applying device according to claim 1, wherein the projections are tapered.

3. The pressure-applying device according to claim 1, wherein the pressure-applying portion has recesses in the back surface at locations adjacent to the projections.

4. The pressure-applying device according to claim 1, wherein the projections are provided at three or more locations.

5. The pressure-applying device according to claim 1, wherein a dimension of the projections in a first direction that is parallel to the back surface is greater than or equal to a dimension of the pressing surface in the first direction.

6. The pressure-applying device according to claim 5, wherein the pressure-receiving object is a paper sheet transported to the pressure-applying device, and wherein the first direction is a direction in which the paper sheet is transported, and the back surface and the pressing surface extend by a distance greater than or equal to a width of the paper sheet in a second direction that crosses the first direction.

7. The pressure-applying device according to claim 1, further comprising:

a belt that surrounds the pressure-applying portion and the pressing portion and circulates while being in contact with a front surface of the pressure-applying portion, wherein the pressure-applying portion applies pressure to the pressure-receiving object with the belt disposed therebetween.

8. A fixing device comprising:

a pair of fixing portions to which a paper sheet having a toner image formed thereon is transported and that fixes the toner image to the paper sheet by applying heat and pressure to the paper sheet while nipping the paper sheet, wherein at least one of the pair of fixing portions includes the pressure-applying device according to claim 7 in which the pressure-receiving object is the paper sheet.

9. An image forming apparatus comprising:

an image forming unit that forms a toner image on a paper sheet; and the fixing device according to claim 8.

10. A pressure-applying device comprising:

a pressure-applying portion that applies pressure to a pressure-receiving object; and a pressing portion that presses the pressure-applying portion toward the pressure-receiving object, the pressing portion having a hardness lower than a hardness of the pressure-applying portion, wherein the pressing portion includes a plurality of projections that project from a pressing surface of the pressing portion that faces the pressure-applying portion toward a back surface of the pressure-applying portion that faces the pressing portion, wherein at least an end portion of at least one of the projections is deformed by being pressed by the pressure-applying portion when the pressure-applying portion and the pressing portion are assembled together.

* * * * *